US007438130B2

(12) United States Patent
Read, Jr.

(10) Patent No.: US 7,438,130 B2
(45) Date of Patent: Oct. 21, 2008

(54) DOWNHOLE ACTUATING APPARATUS AND METHOD

(75) Inventor: Dennis M. Read, Jr., Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/692,214

(22) Filed: Mar. 28, 2007

(65) Prior Publication Data

US 2007/0187115 A1 Aug. 16, 2007

Related U.S. Application Data

(63) Continuation of application No. 10/757,611, filed on Jan. 14, 2004, now Pat. No. 7,216,713.

(60) Provisional application No. 60/440,159, filed on Jan. 15, 2003.

(51) Int. Cl.
*E21B 34/06* (2006.01)

(52) U.S. Cl. ..... 166/319; 166/386; 166/373; 166/321

(58) Field of Classification Search ..... 166/373, 166/386, 332.3, 319, 321
See application file for complete search history.

(56) References Cited

U.S. PATENT DOCUMENTS 4,771,831 A * 9/1988 Pringle et al. ..... 166/319
5,101,904 A * 4/1992 Gilbert ..... 166/319
5,984,014 A * 11/1999 Poullard et al. ..... 166/374

* cited by examiner

*Primary Examiner*—Giovanna C Wright
(74) *Attorney, Agent, or Firm*—Van Someren, PC; Daryl R. Wright; Bryan P. Galloway

(57) ABSTRACT

A method and apparatus for actuating a downhole tool is provided. The apparatus of the present invention includes a remotely energized actuator device that facilitates storage of energy needed to actuate a downhole tool after the device is placed downhole. By energizing the tool downhole, surface exposure to potential safety hazards is reduced.

17 Claims, 6 Drawing Sheets

DOWNHOLE ACTUATING APPARATUS AND METHOD

CROSS-REFERENCE TO RELATED APPLICATIONS

The following is a continuation of U.S. patent application Ser. No. 10/757,611, filed Jan. 14, 2004 now U.S. Pat. No. 7,216,713 which is based on and claims the benefit of priority under 35 U.S.C. §119 to U.S. Provisional Patent Application Ser. No. 60/440,159, entitled, "DOWNHOLE ACTUATOR APPARATUS AND METHOD," filed on Jan. 15, 2003.

TECHNICAL FIELD

The present invention relates to the field of downhole actuators. More specifically, the invention relates to a device and method for remotely energizing a downhole power source.

BACKGROUND

Many downhole tools are actuated by stored mechanical energy sources such as springs or compressed gases. The energy is used to do work on a movable element of the tool, such as a piston or a sliding sleeve. When such tools are operated at great depths, however, the hydrostatic pressure of the wellbore fluid may apply pressures on the moveable element that are comparable to or even greater than the pressures applied by the stored energy. One way to compensate for the large hydrostatic head is to use stiffer springs or higher pressure gas charges to increase the amount of energy stored. That, however, creates a potentially unsafe work environment or may be impossible or impractical to achieve at the surface.

Accordingly, a need exists for an energy storage system that is charged with energy after the system is placed downhole where it is away from personnel and in a high-pressure environment that can help reduce differential pressures. The present invention is directed at providing such a system.

SUMMARY

In general, according to one embodiment of the present invention, a system for use in charging energy for a downhole tool once the tool is run down a wellbore is provided.

In general, according to another embodiment of the present invention, a system for remotely energizing a power source to provide the energy needed to actuate a downhole tool and load that energy into a storage element for use once the tool is placed downhole is provided.

Other or alternative features will be apparent from the following description, from the drawings, and from the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In downhole oilfield tool operations, energy (in the form of high pressure gas) is often used to do work downhole. Often this pressure is applied at surface, creating a potential hazard. Additionally, the pressure required to actuate the tool may be in excess of what is possible to deliver and contain at the surface without the support of resisting external (hydrostatic) pressures or forces. One embodiment of the present invention provides a remotely energized actuator device that facilitates storage of energy needed to actuate a downhole tool after the device is placed downhole. This reduces exposure of a highly charged actuator device at the surface. Moreover, by controlling the volume, (as well as temperature, leverage, and/or stroke proportions), the energy level can be specifically set and trapped by mechanical means. Thus, a wide range of downhole pressure can be stored in the internal volume to do work in a nearly limitless range, with a relatively low amount of energy being stored in the device at surface.

Figure 1:
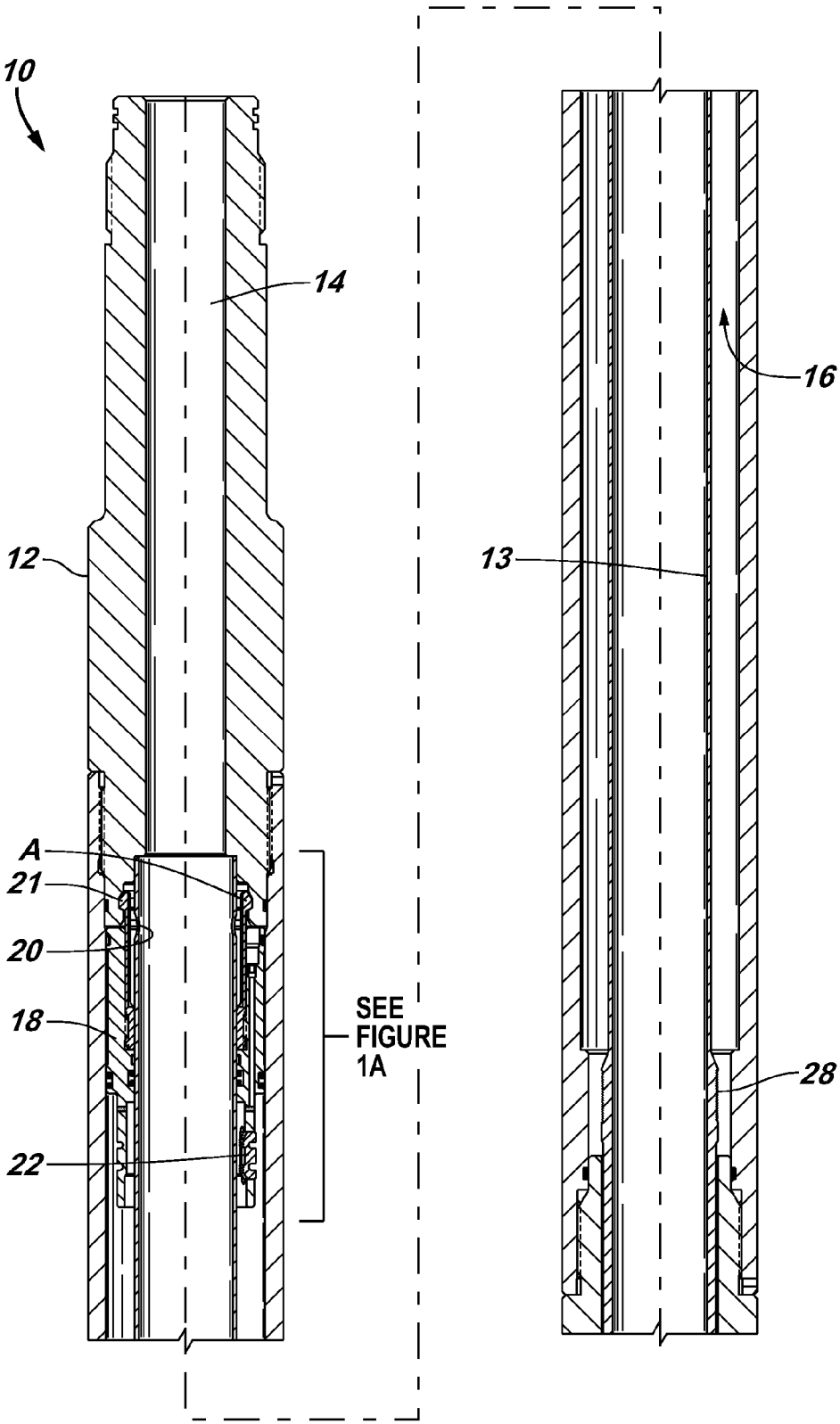
FIG. 1 is a cross-sectional view of an embodiment of the present invention illustrating an actuator device with a piston arranged in a non-energized position.
Figure 1A:
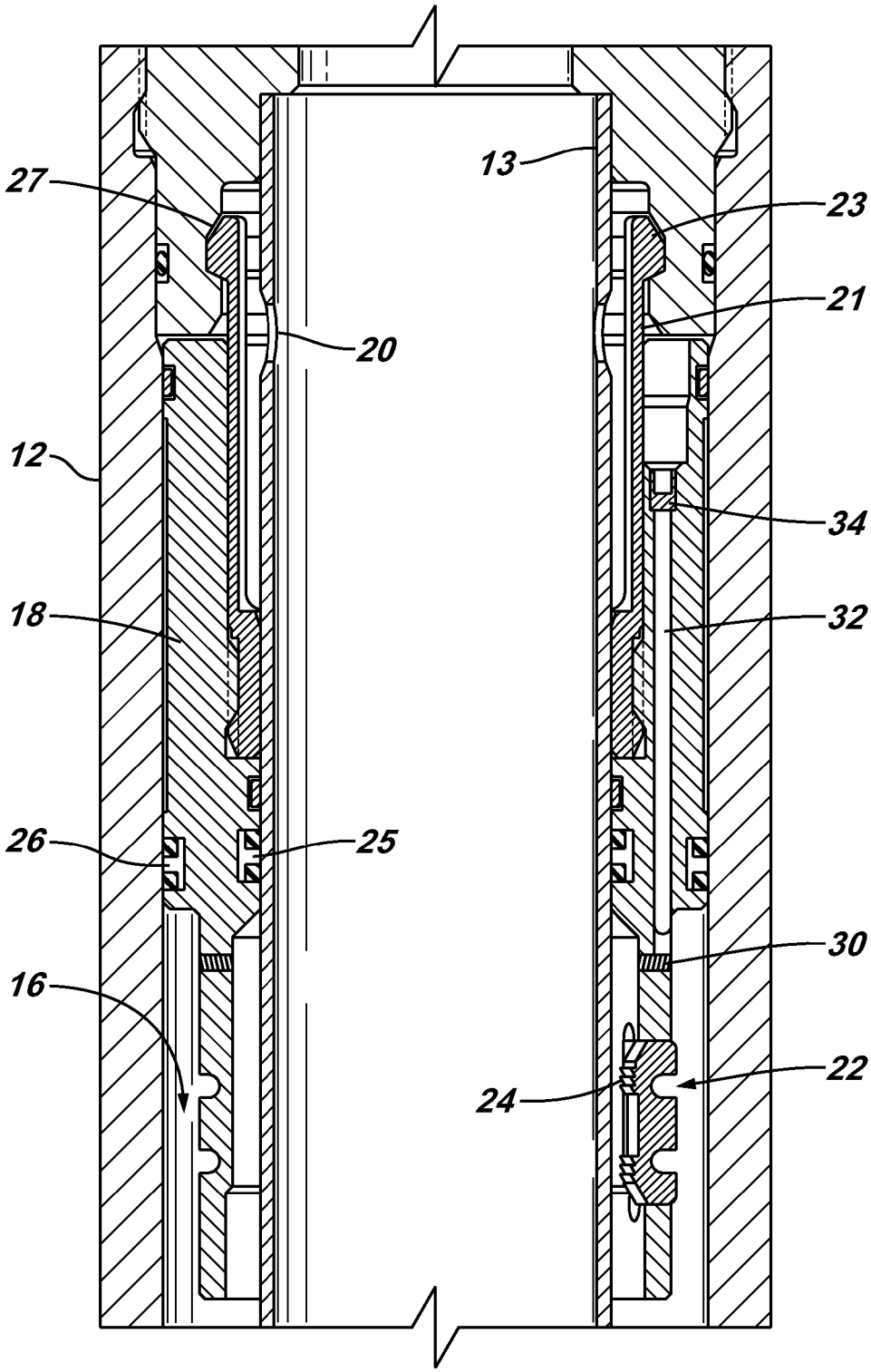
FIG. 1A is an enlarged cross-sectional view of an embodiment of the actuator device of the present invention illustrating the piston arranged in the non-energized position.

Generally, with reference to FIG. 1, one embodiment of the present invention includes an actuator device 10 for remotely receiving and storing an energy charge to actuate a downhole tool. The actuator device 10 includes a piston assembly 18 that initially reacts to the hydrostatic head to compress a spring element (gas or mechanical) 16 so as to maintain equal pressure on either side of the piston assembly as the tool is lowered into the wellbore. Once the tool, along with the device 10, is in place, additional forces are applied to the piston 18 to further compress the spring 16. That additional energy can be released, when desired, to actuate the tool.

Figure 2:
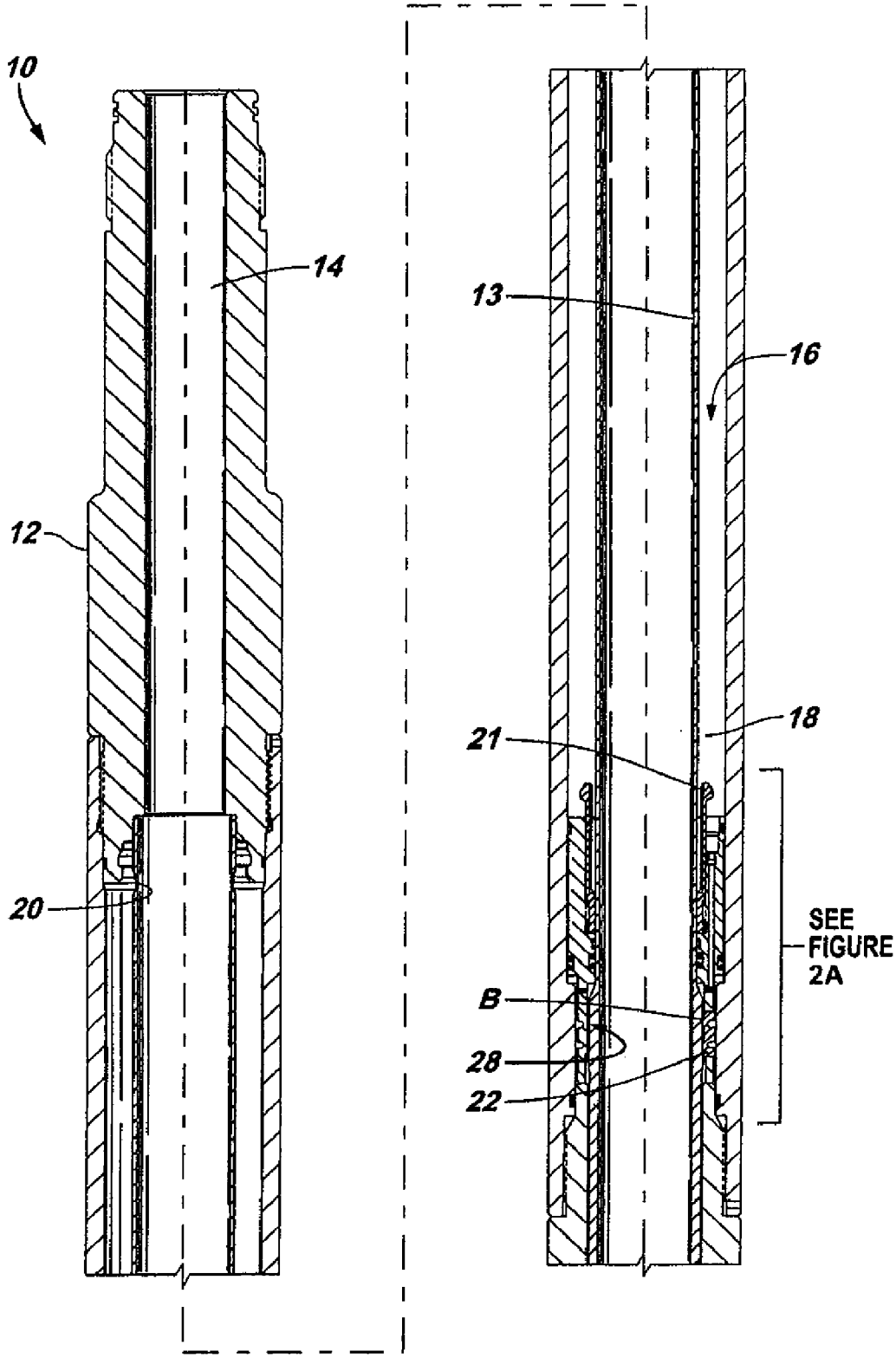
FIG. 2 is a cross-sectional view of an embodiment of the present invention illustrating the actuator device with the piston arranged in an energized position.
Figure 2A:
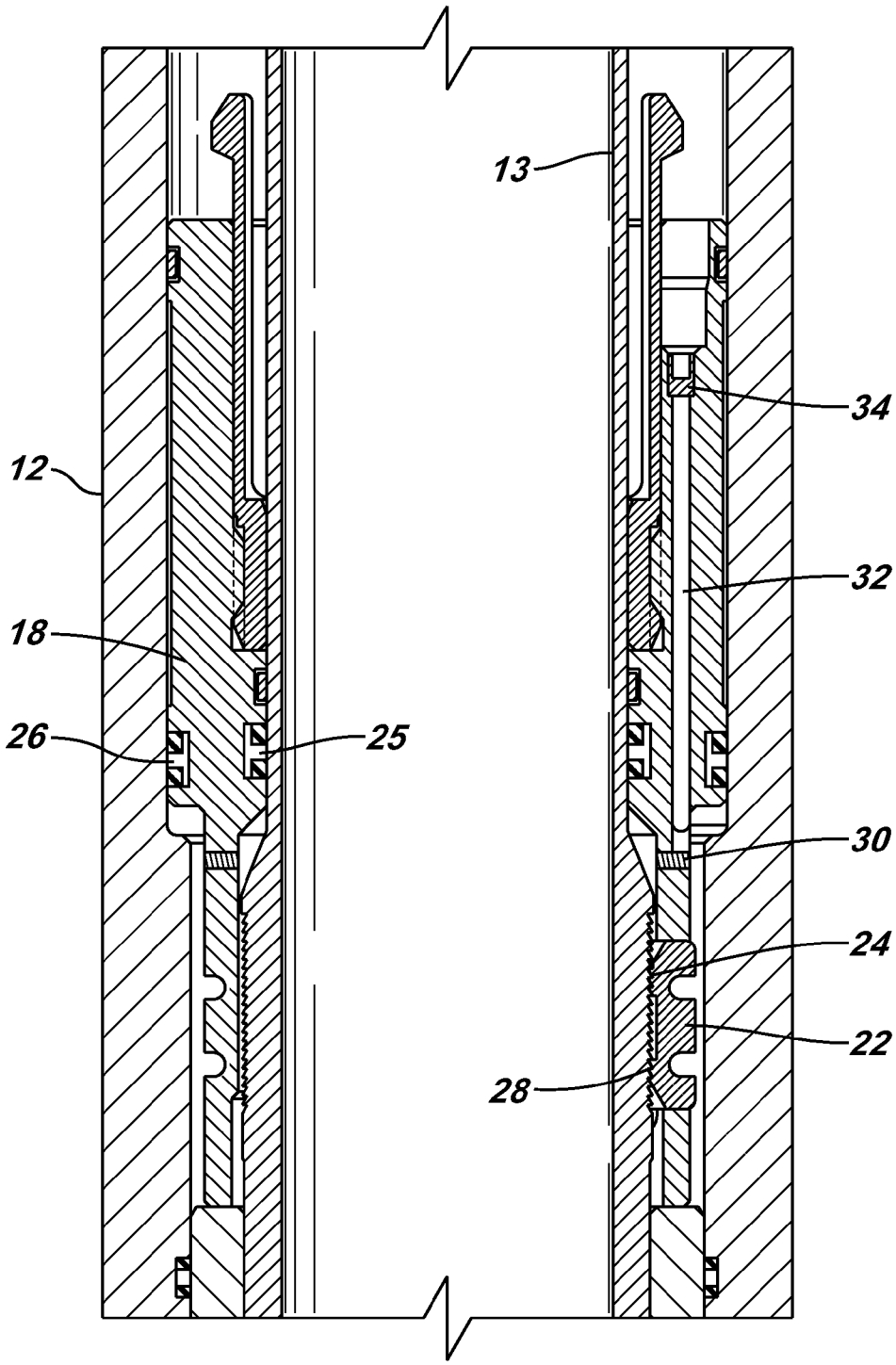
FIG. 2A is an enlarged cross-sectional view of an embodiment of the actuator device of the present invention illustrating the piston arranged in the energized position.

More particularly, with reference to FIGS. 1-2, an embodiment of the present invention includes an actuator device 10 comprising a tool body 12. The tool body 12 includes an axial bore 14, a gas chamber 16, and a piston arranged within the gas chamber. In one example, an inner sleeve 13 may be employed to define the central axial bore 14 and the gas chamber 16, as shown in FIGS. 1-2. In another example, the axial bore 14 and gas chamber 16 may be integral with the tool body 12 (not shown). The annular piston 18 is arranged in the gas chamber 16 around the axial bore 14. Fluidic communication is provided between the central axial bore 14 and the gas chamber 16 via a set of ports 20 formed in the sleeve 13 at a location above the piston 18.

The gas chamber 16 may be provided with an initial gas charge. In one example, the gas is nitrogen or some other inert and/or compressible gas and the charge is a pressure that is common for well site handling (e.g., less than 5000 psi) although other pressures may be employed. Furthermore, other embodiments of the present invention may include a mechanical spring in place of the compressible gas spring.

The annular piston 18 includes a set of latching fingers 21 and a ratchet device 22. Each of the latching fingers 21 includes a protruding element 23 biased radially outward. The ratchet device 22 includes a mating surface 24 having a "tooth-like" profile biased radially inward. Moreover, the annular piston 18 includes a set of seals 25, 26 for sealing against the outer wall of the sleeve 13 and the inner wall of the gas chamber 16.

The actuator device 10 further includes a first latching position A and a second latching position B to facilitate axial translation of the annular piston 18. The first latching position A includes recesses 27 formed in the inner wall of the tool body 12 to receive the set of latching fingers 23 of the piston 18. The second latching position B includes a set of mating elements 28 formed on the outer wall of the sleeve 13 to receive the mating surface 24 of the ratcheting device 22.

In other embodiments of the present invention, other structures may used to facilitate latching the annular piston 18 at positions A and B instead of latching fingers 23 and a ratchet device 22. For example, ratchets, snap rings, pins, colletts, latching fingers, and other structures having similar functions may be used.

In operation, with reference to FIGS. 1-2, the actuator device 10 may be connected in series with one or more downhole tools and suspended in a wellbore using tubing (or other structures including wire line or slick line). For example, the actuator device 10 may be suspended in a wellbore by jointed or coiled well tubing. The gas chamber 16 of the actuator device 10 is charged with a compressible gas (such as nitrogen) at the surface and the actuator device, along with the downhole tool, is run down the wellbore with the annular piston 18 initially in the first latching position A. In the first latching position A, the protruding elements 23 of the latching fingers 21 of the annular piston 18 engage the recesses 27 formed along the inner wall of the tool body 12. FIG. 1 shows the annular piston 18 in the first latching position A.

As the actuator device 10 is lowered through the wellbore, hydrostatic pressure builds within the axial bore 14 and acts against the piston 18 via the ports 20. Once the hydrostatic pressure reaches a predetermined level, the fingers 21 disengage from the recesses 27 and the piston is free to move axially downward such that the hydrostatic pressure in the axial bore 14 and the pressure of the gas confined in the chamber 16 are equalized.

Once the actuator device 10 is at the target depth or desired position in the wellbore, the pressure in the gas chamber 16 may be increased via the tubing (or other conduit such as a control line or annulus) to move the piston 18 axially downward and further compress the gas charge in the gas chamber 16. At the desired pressure, the piston 18 locks into position via a ratchet 22 or other similar mechanism. The mating surface 24 of the ratchet 22 engages the mating elements 28 formed on the outer wall of the sleeve 13. FIG. 2 shows the piston 18 in the second latching position in which the ratchet mechanism 22 is engaged.

With the ratchet 22 engaged, the actuating pressure within the gas chamber 16 is set. This trapped pressure may serve to deliver the required energy to actuate the downhole tool.

In another embodiment of the present invention, the ratchet device 22 has a shear mechanism 30 that causes the ratchet to shear if the differential pressure between the gas charge in the gas chamber 16 and the pressure in the tubing exceeds a predetermined limit. For example, if the pressure in the axial bore 14 falls below a predetermined limit (causing an excessive differential pressure) the ratchet device 22 will shear. When the ratchet device 22 shears, the piston 18 is free to move within the gas chamber 16. The moving piston 18 will cause the pressure in the gas chamber 16 to equalize with the pressure in the axial bore 14 via the set of ports 22. In this way, when the actuator device 10 is retrieved to the surface, the pressure in the gas chamber 16 is at a level that is safe to handle. Examples of a shearing mechanism 30 for use in releasing the piston 18 from the ratchet device 22 include, inter alia, shear pins, a shearable region formed by reducing material thickness or fabricated from shearable material, and so forth.

In yet another embodiment of the present invention, the annular piston 18 includes a central passageway 32 extending from a first end to a second end and a rupture disk 34 therein. As with the shear mechanism described above, the rupture disk 34 is formed to break at a predetermined differential pressure. If the differential pressure exceeds a predetermined level, the rupture disk 34 will rupture releasing the gas charge from the gas chamber 16 via the passageway 32. In this way, when the actuator device 10 is retrieved to the surface, the pressurized gas charge is not present and the downhole tool is safe to handle.

In still another embodiment of the present invention, the rupture disk 34 and the shear mechanism 30 may be provided in combination to add safety redundancy.

In a further embodiment of the present invention, instead of a gas charge being compressed to store the required energy to actuate the downhole tool, a mechanical spring may be employed.

Figure 3:
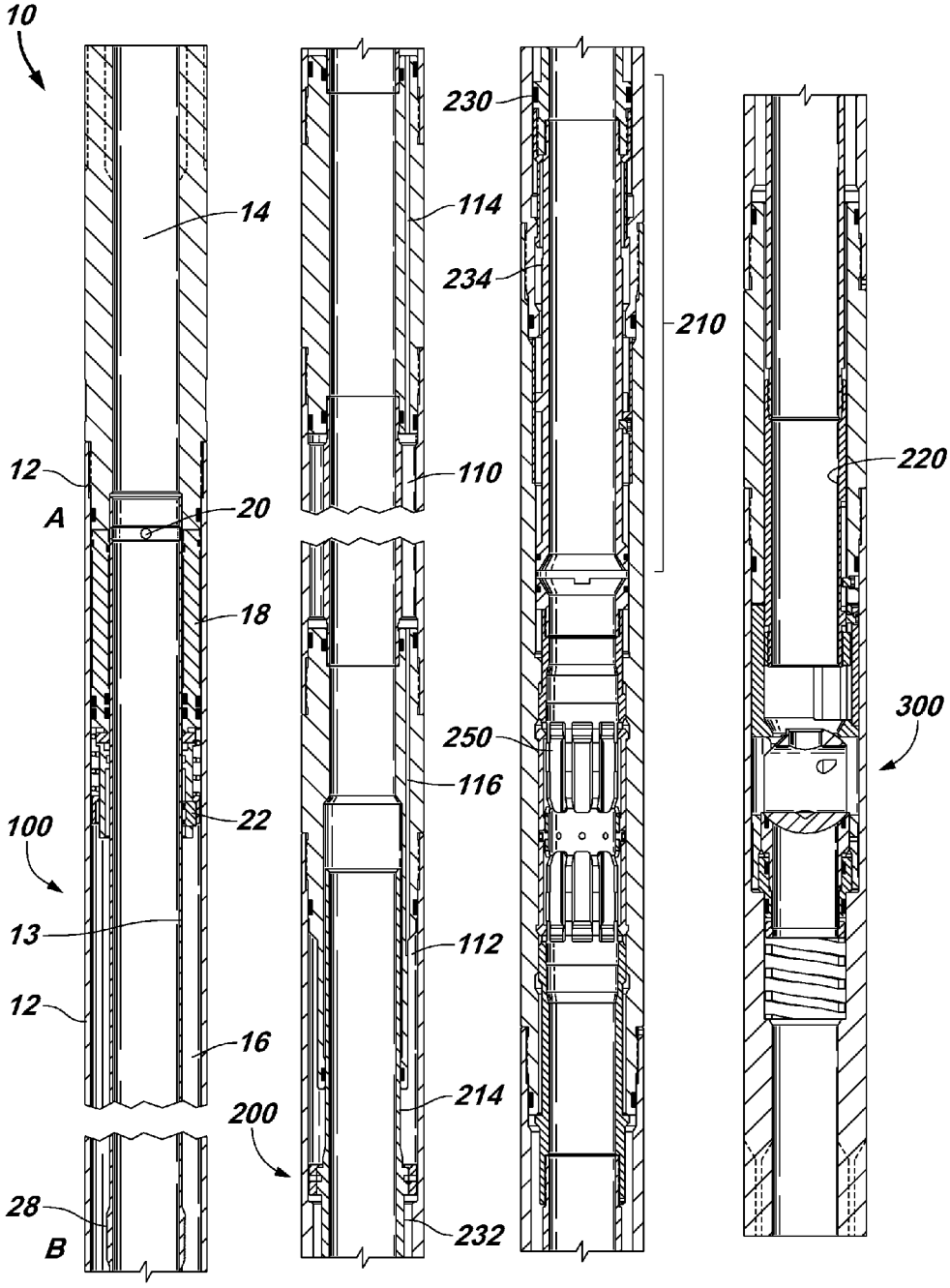
FIG. 3 is a cross-sectional view of an embodiment of the present invention for use in combination with a downhole tool illustrating the actuator device with the piston arranged in an initial non-energized position for running down a wellbore.
Figure 4:
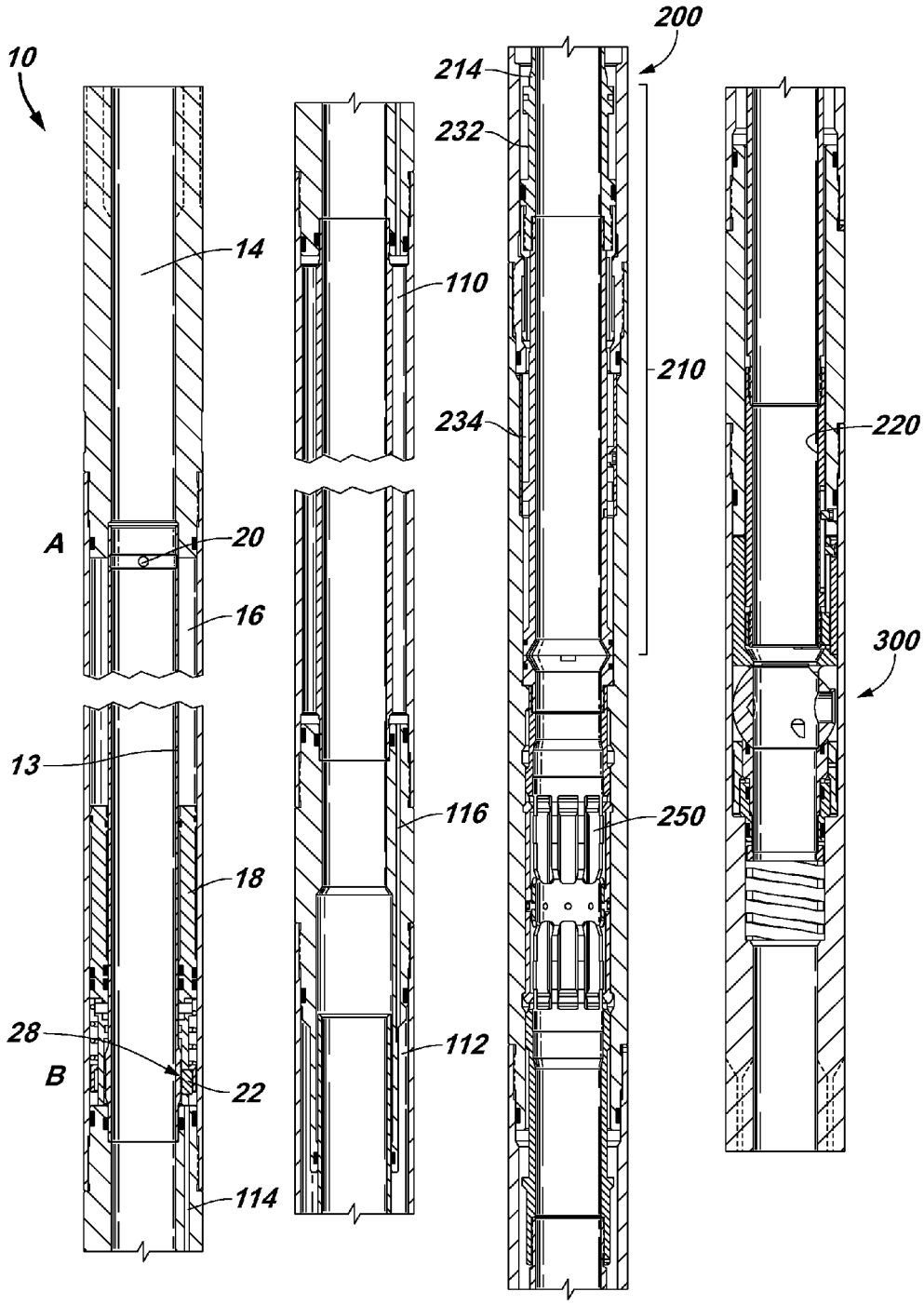
FIG. 4 is a cross-sectional view of an embodiment of the present invention for use in combination with a downhole tool illustrating the actuator device delivering the required charge of energy to actuate the downhole tool.

With reference to FIGS. 3-4, in another embodiment of the present invention, the actuator device 10 is connected to a valve 300. The actuator device 10 provides the gas charge (or alternatively, the mechanical spring force) necessary to operate the valve 300 in the wellbore at an elevated pressure.

The valve 300 shown in the FIGS. 3-4 is an isolation valve similar to that disclosed in U.S. Pat. No. 6,230,807, issued May 15, 2001, which is incorporated herein by reference. By way of example, the actuator 10 of the present invention may be used in the place of the gas charge 110 shown in FIGS. 2-6 of the '807 patent.

The valve 300 shown in FIGS. 3 and 4, however, is for illustration purposes only. The actuator device 10 of the present invention may be used in connection with any tool used in a well that requires actuation to supply an operating force. For example, the tool shown in FIGS. 3 and 4 is for a valve used for isolation. Another example of a tool that commonly uses a spring force or gas charge is a safety valve. Thus, the present invention may be used in combination with a safety valve or other downhole-actuated equipment.

Still with reference to FIGS. 3-4, the valve 300 is a ball valve moveable between a closed position (FIG. 3) and an open position (FIG. 4). To facilitate moving the valve 300 between the closed position and the open position, the actuator device 10 includes an energizing section 100 and an actuating section 200.

The energizing section 100 includes those components discussed above and shown in FIGS. 1-2 for receiving and storing energy by compressing a gas in a chamber 16 (or mechanical spring) by shifting a piston 18 from a first position A to a latched position B once the tool is positioned in a well.

As more fully described in the '807 patent, the actuating section 200 includes a counter mechanism 210, a power mandrel 214, and a valve operator 220. The power mandrel 214 includes a seal 230 for sealing against the tool body 12 to define an annular space 232 above the power mandrel 214 and an annular space 234 below the power mandrel. The annular space 232 above the power mandrel 214 communicates with the gas chamber 16 via one or more lower gas chambers 110, 112 and one or more conduits 114, 116. The annular space 234 below the power mandrel communicates with the axial bore 14.

In operation, with reference to FIG. 3, the actuator device 10 is connected to the valve tool 300 and is run downhole with the piston 18 in the first latching position A. In this example, the valve 300 is closed for run-in and setting of packers (not shown) in the completion of the well.

As the actuator device 10 and the valve tool 300 are lowered into the well, fluid may be communicated from the surface via a tubing string (or other conduit such as a control line or annulus) through the axial bore 14 to shift the piston 18 downward into the second latching position B. In this way, the gas in the gas chamber 16 is compressed to a predetermined level to charge the energizing section 100 (as discussed above in connection with FIGS. 1-2). This results in a downward gas pressure on the power mandrel 214.

With reference to FIG. 4, once the actuator device 10 and the valve tool 300 reach target depth for tool actuation, fluid may again be communicated from the surface via a tubing string through the axial bore 14 to the annular space 234 below the power mandrel 214. This results in an upward fluid pressure on the power mandrel 214. When the fluid pressure exceeds the gas pressure, the power mandrel 214 moves up. When fluid is bled from the tubing string and axial bore 14, the fluid pressure drops and the power mandrel 122 is pushed back down. Each up and down movement of the power mandrel 214 makes up a cycle. After a predetermined number of cycles, the counter section 210 is activated to allow the power mandrel 214 to cause the valve operator 220 to move axially downward. For example, the cyclical activation of the power mandrel 214 may be accomplished by a pin and J-slot mechanism as shown in FIG. 6 of the '807 patent. The downward movement of the valve operator 220 causes the valve 300 to rotate from its closed position (FIG. 3) to its open position (FIG. 4). This cycled actuation of the ball valve 300 can be repeated.

In another embodiment of the present invention, the valve 300 includes a collett 250 to prevent opening of the valve during transport downhole (FIG. 3) and to hold the valve in the open position (FIG. 4). The collett 250 also provides for mechanical shifting of the valve 300 to close the valve if desired.

In yet another embodiment of the present invention, the actuator may be connected to additional energy charging and storage devices to magnify or intensify the actuating pressure available to actuate a downhole tool.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. Apparatus for remotely charging and storing energy to operate a tool positioned in a well, comprising:

a tool body having a central bore formed therethrough;

a moveable piston arranged in the tool body;

a spring arranged in the tool body, the spring adapted to engage the piston; and a latching mechanism positioned to selectively lock the piston to the tool body in a first latched position during movement downhole, wherein energy is charged by moving the piston to compress the spring to a point of equilibrium with the wellbore pressure, and further wherein additional energy is stored by forcing the piston to further compress the spring beyond the point of equilibrium and then locking the piston once the spring is further compressed.

2. The apparatus of claim 1, wherein the piston is adapted to be moved by differential pressure between the well and the spring.

3. The apparatus of claim 2, wherein the spring comprises:

a gas chamber formed in the tool body; and a compressible gas located in the gas chamber.

4. The apparatus of claim 3, wherein the piston is arranged in the gas chamber.

5. The apparatus of claim 3, wherein the gas comprises nitrogen.

6. The apparatus of claim 2, wherein the spring comprises:

a mechanical spring.

7. A method for energizing a tool in a well, comprising:

lowering the tool into the well, the tool having an internal bore and a spring to actuate the tool, the spring being exposed to wellbore pressure via a port extending to the internal bore;

compressing the spring, while in the well, via moving a piston member to a position determined to compress the spring to a compressed state in which the spring exerts a greater force than that applied by the wellbore pressure; and holding the spring member in the compressed state to store energy by mechanically securing the piston member in the position.

8. The method of claim 7, wherein the spring member is a gas spring.

9. The method of claim 7, wherein the spring member is a mechanical spring.

10. The method of claim 7, further comprising:

using the stored energy to actuate the tool by decompressing the spring.

11. The method of claim 10, wherein the tool is a valve.

12. A method, comprising:

running a tool in a well;

latching a piston in the tool at a first latched position for movement downhole;

using pressure in the well to move the piston in the tool to compress a gas, trapped in the tool, to a point of equilibrium with the hydrostatic pressure of the well;

subsequently moving the piston an additional distance to further compress the gas;

locking the piston in the tool to prevent the gas from decompressing; and using the compressed gas to actuate the tool.

13. The method of claim 12, wherein locking the piston is achieved by ratcheting the piston to an inner sleeve in the tool.

14. A method for actuating a valve in a well, the method comprising:

connecting the valve to an actuator;

running the valve downhole such that the actuator is exposed to wellbore pressure;

while downhole, compressing a gas acting on the actuator in a direction opposing the wellbore pressure by moving a piston in the actuator, the gas being compressed to an actuating pressure beyond equilibrium between the gas and the wellbore pressure;

holding the gas in a compressed state at the actuating pressure so as to store energy in the actuator for actuating the valve; wherein the gas is held at the actuating pressure by mechanically engaging the piston to at least a part of the actuator; and decompressing the gas to actuate the valve.

15. The method of claim 14, further comprising latching the actuator in a first position during initial running of the valve into the well.

16. A method for actuating a valve in a well, the method comprising:

connecting the valve to an actuator;

running the valve downhole such that the actuator is exposed to wellbore pressure;

while downhole, compressing a mechanical spring that biases the actuator in a direction opposing the wellbore pressure, the mechanical spring being compressed to an actuating pressure beyond equilibrium between the mechanical spring and the wellbore pressure;

holding the mechanical spring in a compressed state at the actuating pressure so as to store energy in the actuator for actuating the valve; and decompressing the mechanical spring to actuate the valve.

17. The method of claim 16, further comprising latching the actuator in a first position during initial running of the valve into the well.

* * * * *